US011988473B1

(12) United States Patent
Thornton

(10) Patent No.: US 11,988,473 B1
(45) Date of Patent: May 21, 2024

(54) OXYHYDROGEN KINETIC ENERGY WEAPONS SYSTEM

(71) Applicant: MACH INDUSTRIES INC., Austin, TX (US)

(72) Inventor: Ethan Thornton, Boerne, TX (US)

( * ) Notice: Subject to any disclaimer, the term of this patent is extended or adjusted under 35 U.S.C. 154(b) by 0 days.

(21) Appl. No.: 18/194,162

(22) Filed: Mar. 31, 2023

Related U.S. Application Data

(60) Provisional application No. 63/327,012, filed on Apr. 4, 2022.

(51) Int. Cl.
*F41A 1/04* (2006.01)
*F41A 1/08* (2006.01)

(52) U.S. Cl.
CPC .. *F41A 1/04* (2013.01); *F41A 1/08* (2013.01)

(58) Field of Classification Search
CPC ..... F41A 1/02; F41A 1/04; F41A 1/08
USPC ..... 124/60; 89/1.809, 8, 28.1, 28.2, 7
See application file for complete search history.

(56) References Cited

U.S. PATENT DOCUMENTS

| | | | | |
|---|---|---|---|---|
| 2,965,000 | A | 12/1960 | Skinner | |
| 3,465,638 | A | 9/1969 | Canning | |
| 4,653,380 | A | 3/1987 | Griffing | |
| 5,078,117 | A | 1/1992 | Cover | |
| 5,703,322 | A | 12/1997 | Tidman | |
| 6,517,010 | B1 | 2/2003 | Barykin | |
| 7,254,914 | B2 | 8/2007 | Lund | |
| 7,665,396 | B1 | 2/2010 | Tippmann | |
| 7,775,148 | B1 * | 8/2010 | McDermott | F41B 11/723 89/1.809 |
| 8,826,792 | B1 * | 9/2014 | Granger | F41A 1/04 89/7 |
| 2004/0144012 | A1 | 7/2004 | Adams | |

FOREIGN PATENT DOCUMENTS

RU 2755748 C1 * 9/2021

* cited by examiner

*Primary Examiner* — John Cooper
(74) *Attorney, Agent, or Firm* — Egbert, McDaniel & Swartz, PLLC

(57) ABSTRACT

A weapon has a barrel, a body connected to the barrel, a cylindrical part affixed to an internal cavity of the body, a magazine cooperative with the cylindrical part so as to dispense a projectile adjacent a front chamber of the cylindrical part, a receiver positioned in the front chamber of the cylindrical part, an actuator cooperative with the receiver, and a trigger cooperative at the front chamber of the cylindrical part so as to ignite oxyhydrogen gas in the front chamber in order to file the projectile through the barrel. The magazine has an oxyhydrogen tank in an interior thereof. The oxyhydrogen tank being in communication with the front chamber and the rear chamber of the cylindrical part. The receiver is adapted to receive a bullet therein. There actuator is adapted to move the receiver in order to chamber the projectile.

21 Claims, 3 Drawing Sheets

OXYHYDROGEN KINETIC ENERGY WEAPONS SYSTEM

RELATED U.S. APPLICATIONS

The present application claims priority to Provisional Application No. 63/327,012, filed on Apr. 4, 2022.

BACKGROUND OF THE INVENTION

1. Field of the Invention

The present invention relates to guns, rifles and similar weapons. More particularly, the present invention relates to weapons that utilize a combustible gas as a means for firing a projectile from the weapon. More particularly, the present invention relates to the use of oxyhydrogen as the fuel for firing the weapon.

2. Description of Related Art Including Information Disclosed Under 37 CFR 1.97 And 37 CFR 1.98

Numerous devices and mechanisms have been devised for propelling a projectile toward a target. Firearms, for example, use the sudden release of pyrotechnic gases from a gunpowder or other pyrotechnic charge to propel a bullet. Due to government control and other restraints placed upon firearms, however, other means of providing a projectile propulsion force have been developed. Such non-pyrotechnic devices include devices for releasing compressed gas, such as $CO_2$, from a compressed or liquefied gas capsule to project a projectile.

Some compressed gas cartridge weapons are adapted to utilize a single compressed gas cartridge for providing the propellant force for a number of different projectiles. For example, U.S. Pat. No. 4,150,656 to Curran, discloses such a multi-shot weapon utilizing compressed gas released from a compressed gas capsule to provide the propellant force. However, multi-shot compressed gas devices suffer from a number of problems. One problem is that the devices require relatively large and heavy gas metering mechanisms for releasing only the desired quantity of propellant gas for each shot. The multi-shot compressed gas capsule itself is relatively large and heavy and requires a large housing. This increases the overall size of the weapon. Another problem with multi-shot compressed gas devices is leakage of compressed gas from the gas capsule. The gas capsules are commonly punctured to open a flow of compressed gas to the metering mechanism and pressure is often times lost due to an imperfect seal around the punctured opening. Furthermore, multi-shot devices generally require a propellant gas, such as $CO_2$, that liquefies at relatively low pressures in order to provide a sufficient number of shots per gas cartridge. Although large volumes of $CO_2$ may be stored in the liquid phase, weapons that use the liquefied gas must have a bulky gas expansion chamber to convert the stored liquid into a usable gas propellant.

Other weapons that use compressed gas from a compressed or liquefied gas capsule for providing ballistic propulsion force are adapted to expand the compressed material capsule in a single shot. For example, U.S. Pat. No. 2,725,048 to Koogle and U.S. Pat. No. 2,660,993 to Blakes-Lee are each directed to a single shot compressed or liquefied gas capsule-powered device. Both of these devices use a manually-actuated puncturing mechanism to puncture an opening in the compressed material capsule to release the compressed material and fire the weapon. Such manually-actuated capsule-puncturing mechanisms were large and bulky so as to increase the overall size of the weapon. Since the user supplied the capsule puncturing force, the thickness of the capsule walls, and thus the capsule pressure, is severely limited. Also, the prior single shot compressed or liquefied gas capsule devices provided only a small flow area for releasing gas to propel the projectile and thus make inefficient use of the available energy. Furthermore, the manually-operated mechanical-puncturing devices operate relatively slowly to release the compressed gas. This requires that the weapon be held on the target for a relatively long period of time.

In the past, various patents and patent application publications have issued with respect to weapons that use a compressed gas for the firing of a weapon.

U.S. Pat. No. 2,965,000, issued a Dec. 20, 1960 to L. A. Skinner, is an early patent in this field. This patent describes a liquid propellant, regenerative feed and a recoilless gun. The invention utilizes a thin-walled gun tube or barrel and employs liquid propellants of the hypergolic type for creating the operating pressures for discharging the projectiles from the gun barrel or tube and actuating the repeated firing or automatic operational cycles of the gun. The gun includes enlarged gas or combustion and pressure chambers at the inner end of the gun tube with gas exhaust conduits or tubes extending rearwardly from the pressure chamber and having restricted gas discharge nozzles at their rear ends for a counteracting recoil. A projectile feeding magazine is connected at its rear end to the combustion chamber by a pressure supply conduit for introducing pressure chamber pressure into the projectile feeding tube behind the projectile so as to feed them into the gun tube one at a time. A check valve is interposed in the connection. A pressure regulator is provided to control the maximum projectile feeding pressure.

U.S. Pat. No. 3,465,638, issued on Sep. 9, 1969 to T. N. Canning, describes a hyper-velocity gun. This hyper-velocity gun is an implosion-driven, light-gas gun. This gun comprises a launching tube that is made of a suitable ductile or yieldable material and is closed at one end thereof. A projectile is disposed within the launching tube and spaced from the closed end thereof. A light propellant gas is contained within the launching tube between the closed end thereof and the projectile to be propelled. A suitable high explosive charge surrounds the launching tube commencing at the closed end thereof and extending to the portion of the launching tube intermediate the location of the projectile. An initiator or detonator is disposed at the closed end of the launching tube to detonate the high explosive charge.

U.S. Pat. No. 4,653,380, issued on Mar. 31, 1987 to Griffing et al., teaches a bipropellant gun which utilizes an immiscible hydrocarbon fuel and oxidizer. These are combined in the gun's combustion chamber just prior to, or simultaneous with, ignition. The oxidizer has hydrogen peroxide having a concentration of less than 73% by weight. The oxidizer alone is bulk-loaded into the combustion chamber and a powdered solid hydrocarbon fuel is dispersed into the oxidizer by the function of a pyrotechnic igniter.

U.S. Pat. No. 5,078,117, issued on Jan. 7, 1982 to C. H. Cover, discloses a projectile propellant device adapted to supply compressed gas from a compressed gas container for providing a propulsion force for a projectile for providing the operating force for a gas-powered device. The propellant device includes a gas container containing a volume of gas at a sufficient pressure for applying a desired force upon release. A compressed gas releasing structure is provided for producing a release opening in the compressed gas container in response to the detonation of a pyrotechnic material. The release opening releases the compressed gas for applying the desired force to propel the projectile. The gas releasing structure includes a pyrotechnic charge device and a puncturing device both mounted within a suitable housing along with the gas container.

U.S. Pat. No. 5,703,322, issued on Dec. 30, 1997 to D. A. Tidman, discloses a cartridge having a high-pressure light gas. This cartridge accelerates a projectile and includes the light gas pressurized in a sealed container at between 5000 and 10,000 p.s.i. Upon ignition in the sealed container, a gas mixture having a low or intermediate molecular weight and a high or low energy density is applied as a high speed gas to accelerate the projectile to speeds above 2.4 km/sec.

U.S. Pat. No. 6,517,010, issued on Feb. 11, 2003 to Barykin et al., provides a system for igniting gas into a detonation projection gun. The system does not incorporate mechanical closing valves or systems for the supply of combustible gas. The supply of gas occurs directly and separately to the detonation chamber through a series of independent passages. One of the passages is for the comburant and another passage for the combustibles. Each passage is comprised of an expansion chamber and a plurality of distribution conduits having a reduced cross-section. The expansion chamber of each passage communicates directly with the corresponding supply line. The distribution conduits are distributed so that multiple gas injection points open out at the internal surface of the combustion chamber in order to produce a continuous and separate supply of gas at multiple points so as to ensure a direct and homogenous combustible mixing in the combustion chamber and with a flow which is sufficient to fill the chamber in each detonation cycle.

U.S. Pat. No. 7,254,914, issued on August 14,007 to Lund et al., teaches a hydrogen-operated recreational launcher. This hydrogen-operated gun shoots projectiles, such as paint pellets. Hydrogen gas is supplied to a combustion chamber and is combusted by a trigger-controlled piezoelectric igniter. The hydrogen may be supplied by a hydrogen generator or by a hydrogen storage container located in the gun housing. Suitable valve mechanisms are provided to control the flow of hydrogen to the combustion chamber and the expelling of exhaust gases from the combustion chamber.

U.S. Pat. No. 7,665,396, issued on Feb. 23, 2010 to T. J. Tippmann, provides a projectile launcher for paintballs. This apparatus includes a body defining a combustion chamber and a bore. A front bolt is provided that moves between a first position and a second position in which at least a portion of the front bolt is disposed within the combustion chamber in the first position. A rear bolt is movable between a third position and a fourth position such that the least a portion of the rear bolt is disposed within the combustion chamber in the fourth position. A drive mechanism is provided to urge the rear bolt to the fourth position. The apparatus includes an igniter device adapted to ignite a combustible combustible mixture within the combustion chamber to propel the projectile through the bore.

U.S. Patent Application Publication No. 2004/0144012, published on Jul. 29, 2004 to J. S. Adams, shows an onboard combustion-gas-powered engine that supplies power to a paintball marker or other projectile launcher for generating gas pressure pulses for propelling paintballs and other projectiles. The combustion gas is produced by the engine can be allowed to rise in pressure within a confined volume of space before being released through a valve into a barrel for applying enhanced pressure pulses to the projectiles.

It is an object of the present invention to provide a weapon system that has greater energy density of the ammunition.

It is another object of the present invention to provide a weapon system that has less complexity than other weapon systems.

It is another object of the present invention to provide a weapon system that has greater projectile velocity.

It is another object of the present invention provide a weapon system that utilizes less expensive ammunition.

It is another object of the present invention provide a weapon system has the ability to vary power output from the same platform.

It is another object of the present invention to provide a weapon system that simplifies military production and supply lines.

It is another object of the present invention provide a weapon system that has greater reliability.

It is another object of the present invention to provide a weapon system that has reduced part cost.

It is a further object of the present invention to provide a weapon system that eliminates residue from gun powder combustion.

It is another object of the present invention provide a weapon system that eliminates the port required for cartridge ejection.

It is a further object of the present invention to provide a weapon that has minimal recoil.

These and other objects and advantages of the present invention will become apparent from a reading of the attached specification and appended claims.

BRIEF SUMMARY OF THE INVENTION

The present invention is a weapon that comprises a barrel, a body connected with the barrel, a cylindrical part affixed within an internal cavity of the body, a magazine cooperative with the cylindrical part so as to dispense a projectile adjacent the front chamber of the cylindrical part, a receiver position in a front chamber of the cylindrical part, an actuator cooperative with the receiver, and a trigger cooperative with the front chamber of the cylindrical part so as to ignite an oxyhydrogen gas in the front chamber in order to fire the projectile through the barrel. The cylindrical part has both a front chamber and a rear chamber. The magazine has an oxyhydrogen tank on an interior thereof. The oxyhydrogen tank is in communication with both the front chamber and the rear chamber of the cylindrical part. The receiver is adapted to receive the projectile therein. The actuator is adapted to move the receiver in order to chamber the projectile.

A plunger is positioned in the rear chamber of the cylindrical part. The plunger is movable toward the front chamber in order to compress the oxyhydrogen gas in the front chamber. The plunger is movable rearwardly in the rear chamber following the firing of the projectile. The plunger has an outer diameter in fluid-tight sealing relation with an inner wall of the cylindrical part.

A solenoid is cooperative with the actuator. The solenoid is adapted to move the actuator such that the actuator moves the receiver. The solenoid is positioned at a rear of the cylindrical part.

The magazine has a housing extending over the projectiles and the oxyhydrogen tank. The projectiles are arranged in a quad stack in the housing. The solenoid is movable between a first position and a second position. The first position is closed so as to allow the oxyhydrogen gas to enter the front chamber and to allow the oxyhydrogen gas to enter the rear chamber. The second position causes the actuator to contract such that the receiver grabs the projectile.

The weapon can have a power knob thereon. This power knob is adapted to set a volume of the oxyhydrogen gas in the front chamber. The trigger is cooperative with a spark generator. The spark generator is positioned at the front chamber of the cylindrical part. The barrel is threadedly connected to a forward end of the cylindrical part. The receiver has a slot therein. The slot is adapted to receive the projectile therein.

The actuator is connected to the receiver by a dual rack-and-pinion system to convert horizontal linear movement to vertical linear movement. This dual rack-and-pinion system serves to move the receiver in order to chamber the projectile. The magazine has an on/off switch thereon. This on/off switch is adapted to turn the weapon on and off. A range-to-power adjustment is affixed to the body. This range-to-power adjustment is cooperative with the oxyhydrogen tank so as to set a volume of the oxyhydrogen gas in the front chamber relative to a distance to the target or desired energy transfer to the target. An energy selection button is positioned on the body. This energy selection button is adapted to select a velocity of the projectile released through the barrel. The body of the weapon of the present invention has no ejection port formed thereon.

The system of the present invention is built around a long cylindrical part with two differently-sized internal holes and a barrel threaded to the front thereof. The system as a slot for the receiver. An oscillating part of unique geometry is located within this housing. This is the actuator. The actuator is connected to the receiver by a dual rack-and-pinion system in order to convert horizontal linear movement to vertical linear movement. As the actuator moves forward, the receiver moves down to chamber the next projectile. The receiver is first actuated by hand, much in the nature of an AR-15, to chamber the first projectile. After that, the three-way solenoid is used to move the actuator after each round. Gas is first opened to the front, in which a projectile is already situated, thereby seating the projectile, which is slightly oversized against the barrel. Next, back pressure is provided against the plunger of the actuator so as to further pressurize the gas. Upon spark plug ignition of the front gas, the pressure increases, extruding the bullet through the barrel, and racks the actuator back to chamber the next round. Each time the actuator oscillates, it moves the receiver down before pushing in a projectile using the rod attached to it. This full automatic system reduces recoil while allowing combustion pressures to remain constant, even as magazine pressure drops. It allows for different levels of filled gas for variable energy output.

This foregoing Section is intended to describe, with particularity, the preferred embodiments of the present invention. It is understood that modifications to this preferred embodiment can be made within the scope of the appended claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
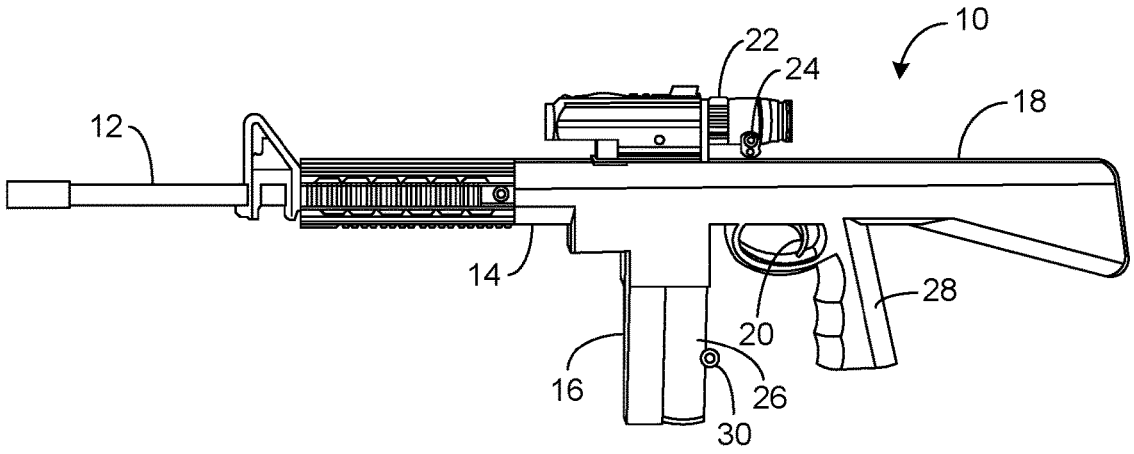
FIG. 1 is a side elevational view showing the weapon in accordance with teachings of the present invention.

Referring to FIG. 1, there is shown the weapon 10 in accordance with teachings of the present invention. The weapon 10 has a barrel 12 that is connected to a body 14. A magazine 16 is located at the bottom of the body 14. A gunstock 18 is located at the rear of the body 14. A trigger 20 is positioned rearwardly of the magazine 16 and cooperative with the internal structures of the body 14. A rangefinder 22 is positioned at the top of the body 14. This rangefinder 22 can include a suitable range-to-power adjustment mechanism 24. The range-to-power adjustment mechanism 24 can be utilized so as to control a volume of the oxyhydrogen gas in the interior of the weapon 10 relative to the target location. The body 14 can further include a system shutdown valve located on the magazine 16 so as to prevent further flow of gas from the oxyhydrogen tank within the tank 26 within the magazine 16 from entering the interior of the body 14. A select-fire knob can also be provided adjacent to the trigger 20 so as to select semi-automatic fire, burst fire, or fully automatic fire. A "select energy" switch can also be provided adjacent to the handle 28 of the weapon 10 so as to allow the user to select the energy imparted to the projectile within the body 14. This "select energy" switch can be set at ranges between non-lethal and lethal energy. FIG. 1 shows that there is a quick disconnect valve 30 positioned on the magazine 16 and cooperative with the oxyhydrogen tank 26 therein. This allows a supply of oxyhydrogen gas, as generated by an electrolysis process on water, to be introduced into the interior of the oxyhydrogen tank 26.

Figure 2:
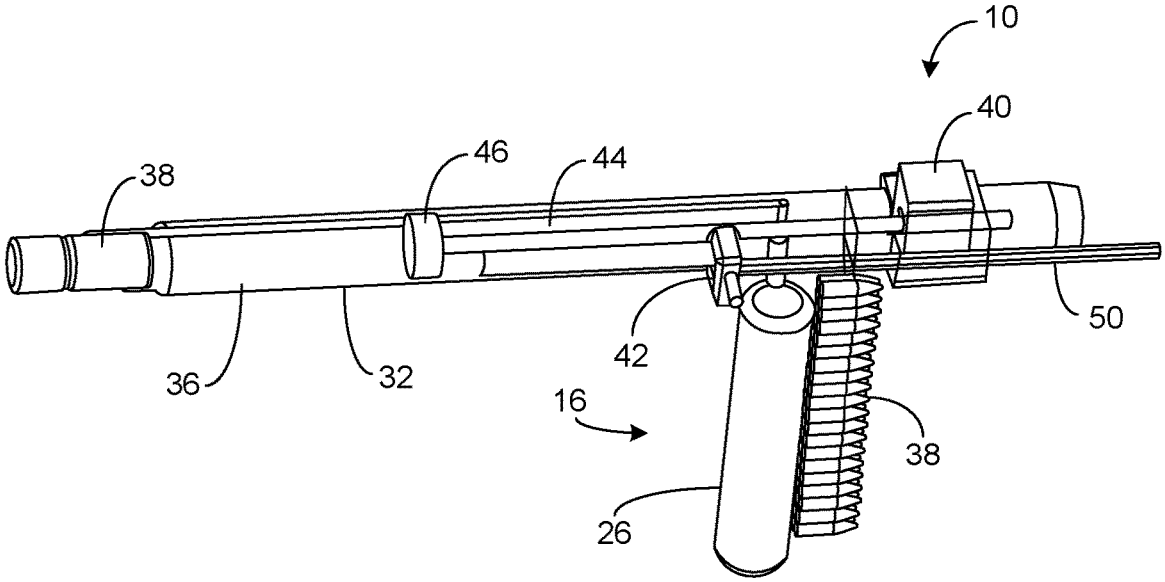
FIG. 2 is a perspective view showing the internal components of the weapon of FIG. 1 of the present invention.

FIG. 2 is a cutaway view showing the interior construction of the weapon 10. FIG. 2 shows that there is a cylindrical part 32 positioned within the interior of the body 14. Cylindrical part 32 has a front chamber 34 and a rear chamber 36. Magazine 16 is shown as cooperative with the cylindrical part 32 so as to dispense a projectile 38 adjacent the front chamber 34 of the cylindrical part 32. The magazine 16 includes the oxyhydrogen tank 26 therein. The oxyhydrogen tank 26 is in communication with the front chamber 34 and with the rear chamber 36 of the cylindrical part 32.

A receiver 40 is positioned at the front chamber 34 of the cylindrical part 32. The receiver 40 is adapted to receive a projectile 38 therein. An actuator 42 is cooperative with the receiver 40. The actuator is adapted to move the receiver 40 in order to chamber the projectile 38 therein. The trigger 20 is cooperative with the front chamber 34 of the cylindrical part 32 so as to ignite the oxyhydrogen gas in the front chamber 34 in order to fire the projectile 38 through the barrel 12.

A plunger 44 is positioned in the rear chamber 36 of the cylindrical part. The plunger 44 is movable toward the front chamber 34 in order to compress the oxyhydrogen gas in the front chamber 34. The plunger 44 is movable rearwardly in the rear chamber 36 following a firing of the projectile 38. The plunger 44 includes a piston 46 that is in fluid-tight sealing relationship with the inner surface of the cylindrical part 32.

A solenoid 48 is cooperative with the actuator 42. The solenoid 48 is adapted to move the actuator 42 such that the actuator moves the receiver 40. The solenoid 48 is positioned in the rear of the cylindrical part 32. The solenoid 48 is movable between a first position and a second position. The first position is closed so as to allow the oxyhydrogen gas to enter the front chamber 34 and to allow the oxyhydrogen gas to enter the rear chamber 36. The second position causes the actuator 42 to contract such that the receiver 40 grabs the projectile. The actuator 42 is connected to the receiver 40 by a worm gear 50. The worm gear 50 is rotatable so as to move the receiver 40 in order to chamber the projectile 38.

Figure 3:
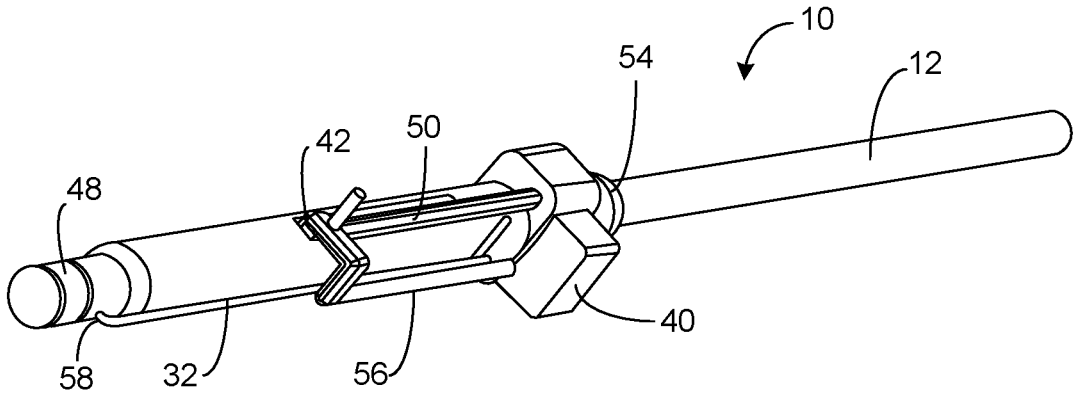
FIG. 3 is an isolated perspective upper perspective view showing the actuator, solenoid, receiver and barrel as used in the present invention.

FIG. 3 further illustrates the construction of the components of the weapon 10 of the present invention. In FIG. 3, it can be seen that the barrel 12 is affixed to a forward end 54 of the cylindrical part 32. The receiver 40 is located adjacent to the barrel 12 at the forward end 54 of the cylindrical part 32. The actuator 42 is geared by rack-and-pinion system 50 to the receiver 40. The actuator 42 has a portion 56 that acts to push the projectile into a slot formed in the receiver 40. Solenoid 48 is located at the rear end 58 of the cylindrical part 32. In normal use, after a firing of a projectile, the solenoid 48 will move rearwardly so as to retract the actuator 42 in the receiver 40. The receiver 40 will rotate, by action of the worm gear 50, so as to move downwardly in order to be adjacent to a projectile located at the top of the quad stack of projectiles 38. The solenoid 48 can then move the actuator 42 forwardly such that the rod 56 pushes the projectile into the slot of the receiver 40. The worm gear 50 can then rotate the receiver 40 into a proper position wherein the projectile is chambered in a location forward of the front chamber of the cylindrical part and facing the interior of the barrel 12.

Figure 4:
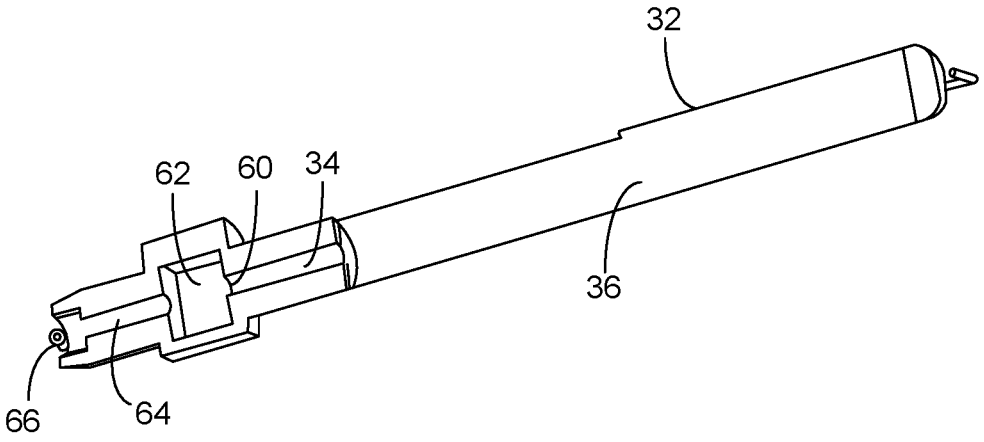
FIG. 4 shows is an upper perspective view showing the configuration of the front and rear combustion chambers of the present invention.

FIG. 4 shows, in particular, the construction of the cylindrical part 32. Cylindrical part 32 includes the rear chamber 36 and the front chamber 34. It can be seen that the rear chamber 36 has a larger diameter than the front chamber 34. As such, the movement of the piston 46 within the interior of the cylindrical part 32 in a direction toward the front chamber 34 will serve to compress the oxyhydrogen gas within the front chamber 34. This controls the amount of force released by the combustion of the oxyhydrogen gas and, hence, the velocity of the projectile. The front combustion chamber 36 can include a small hole 60 that further compresses the gas as directed toward the receptacle 62 for the receiver. A passage 64 will extend from the opening 64 toward the receptacle 66 for the barrel 12.

Figure 5:
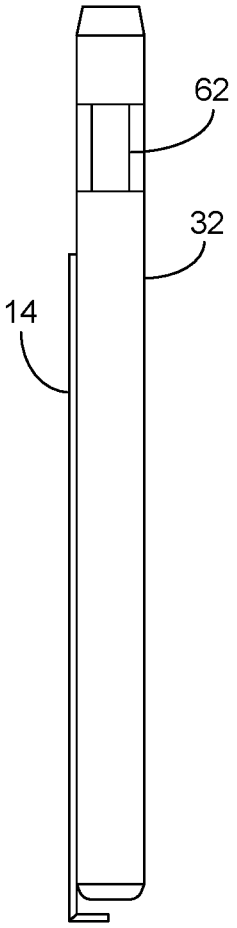
FIG. 5 is a plan view showing the actuator of the present invention.

FIG. 5 illustrates the configuration of the cylindrical part 32. Cylindrical part 32 is received within the body 14 of the weapon 10. The cylindrical part 32 has an end that can be suitably threaded to the barrel. Cylindrical part 32 also includes a slot 62 suitable for receiving the receiver therein.

Figure 6:
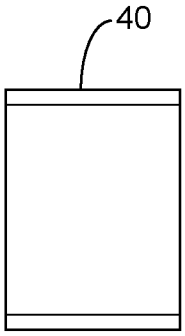
FIG. 6 is a plan view of the receiver of the present invention.
Figure 7:
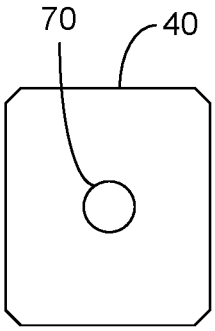
FIG. 7 is an end view showing the receiver of the present invention.

FIG. 6 illustrates the receiver 40. It can be seen that the receiver 40 has a generally square or rectangular configuration. FIG. 7 shows an end view of the receiver 40 in which a slot 70 is provided so as to receive the projectile 38 therein.

The weapon 10 of the present invention utilizes the cylindrical part 32 having the front chamber 34 and the rear chamber 36. The barrel 12 is threaded to the front chamber 34. The cylindrical part 32 includes a slot 62 for the receiver 40. The actuator 42 is an oscillating part of unique geometry. The actuator 42 is connected to the receiver 40 by worm gear 50. Thus, as the actuator 42 moves forwardly, the receiver 40 moves down to chamber the next projectile 38. The receiver 40 is first actuated by hand to chamber a first projectile 38. After that, the three-way solenoid 48 is used to move the actuator 42 for each subsequent round. The oxyhydrogen gas is first opened to the front chamber 34 (in which a round is already situated), thereby seating the round. The round is slightly oversized against the barrel 12. Back pressure is provided against the piston 46 of the plunger 44 so as to further pressurize the gas in the front chamber 34. Upon spark ignition of the gas in the front chamber 34, the pressure increases so as to extrude the projectile through the barrel 12 and racking the actuator 42 in order to chamber the next round. Each time the actuator 42 oscillates, it moves the receiver 40 down before pushing in a round utilizing the rod 56 attached to it. This fully automatic system reduces recoil while allowing combustion pressures to remain constant, even as the magazine pressure drops. It also allows for different levels of fill gas for variable energy output.

The foregoing disclosure and description of the invention is illustrative and explanatory thereof. Various changes in the details of the illustrated construction may be made is the scope of the present invention without departing from the true spirit of the invention. The present invention should only be limited by the following claims and their legal equivalents.

I claim:

1. A weapon comprising:

a barrel;

a body connected to said barrel, said body having an internal cavity;

a cylindrical part affixed within the internal cavity of said body, said cylindrical part having a front chamber and a rear chamber;

a magazine cooperative with said cylindrical part so as to dispense a projectile in an area adjacent the front chamber of said cylindrical part, said magazine having an oxyhydrogen tank on an interior thereof, said oxyhydrogen tank being in communication with the front chamber and the rear chamber of said cylindrical part;

a receiver positioned at the front chamber of said cylindrical part, said receiver adapted to receive the projectile therein;

an actuator cooperative with said receiver, said actuator adapted to move said receiver in order to chamber the projectile; and a trigger cooperative with the front chamber of said cylindrical part so as to ignite the oxyhydrogen gas in the front chamber in order to fire the projectile through the barrel.

2. The weapon of claim 1, further comprising:

a plunger positioned in the rear chamber of said cylindrical part, said plunger being movable toward the front chamber in order to compress the oxyhydrogen gas in the front chamber.

3. The weapon of claim 2, said plunger being movable rearwardly in the rear chamber following a firing of the projectile.

4. The weapon of claim 2, said plunger having a piston at one end thereof, the piston being slidably positioned in said cylindrical part.

5. The weapon of claim 4, the piston being in fluid-tight sealing relation against an inner wall of said cylindrical part.

6. The weapon of claim 1, further comprising:

a solenoid cooperative with said actuator, said solenoid adapted to move said actuator such that said actuator moves said receiver.

7. The weapon of claim 6, said solenoid positioned at a rear of said cylindrical part.

8. The weapon of claim 6, said solenoid being movable between a first position and a second position, the first position being closed so as to allow the oxyhydrogen gas to enter the front chamber and to allow the oxyhydrogen gas to enter the rear chamber, the second position causing said actuator to contract such that the receiver grabs the projectile.

9. The weapon of claim 1, said magazine having a housing extending over the projectile and the oxyhydrogen tank.

10. The weapon of claim 9, said projectile being a plurality of projectiles arranged in a quad stack within said housing.

11. The weapon of claim 1, said magazine having a power knob thereon, the power knob adapted to set a pressure of the oxyhydrogen gas in the front chamber.

12. The weapon of claim 1, said trigger being cooperative with a spark generator, said spark generator being positioned at the front chamber of said cylindrical part.

13. The weapon of claim 1, said barrel being threadedly connected to a forward end of said cylindrical part.

14. The weapon of claim 1, said receiver having a slot therein, said slot adapted to receive the projectile therein.

15. The weapon of claim 1, said actuator being connected to said receiver by a rack-and-pinion system, the rack-and-pinion system being adapted to move said receiver in order to chamber the projectile.

16. The weapon of claim 1, said magazine having an on/off switch thereon, the on/off switch adapted to turn the weapon on and off.

17. The weapon of claim 1, further comprising:

a range-to-power adjustment affixed to said body, said range-to-power adjustment being cooperative with the oxyhydrogen tank so as to set a volume of the oxyhydrogen gas in the front chamber relative to a distance to a target.

18. The weapon of claim 1, further comprising:

an energy selection button positioned on the body, said energy selection button adapted to set a velocity of the projectile released through said barrel.

19. The weapon of claim 1, wherein said body has no ejection port formed thereon.

20. The weapon of claim 1, further comprising:

an oxyhydrogen generator positioned exterior of the weapon, said oxyhydrogen generator being connectable to a quick disconnect valve on said magazine, said oxyhydrogen generator adapted to fill the oxyhydrogen tank with the oxyhydrogen gas.

21. The weapon of claim 1, wherein said magazine supplies both combustible gas and projectiles such that said magazine integrates storage and used transportation to the combustible gas and projectiles.

* * * * *